US008087804B2

(12) United States Patent
Sun

(10) Patent No.: US 8,087,804 B2
(45) Date of Patent: Jan. 3, 2012

(54) ILLUMINATING DEVICE HAVING A SPEAKER

(75) Inventor: Chun-I Sun, Taipei (TW)

(73) Assignee: Kinpo Electronics, Inc., Taipei County (TW)

( * ) Notice: Subject to any disclaimer, the term of this patent is extended or adjusted under 35 U.S.C. 154(b) by 313 days.

(21) Appl. No.: 12/608,782

(22) Filed: Oct. 29, 2009

(65) Prior Publication Data

US 2011/0074266 A1 Mar. 31, 2011

(30) Foreign Application Priority Data

Sep. 29, 2009 (TW) ..... 98132837 A

(51) Int. Cl.
*F21V 29/00* (2006.01)

(52) U.S. Cl. ..... 362/294; 362/373; 381/397; 381/124

(58) Field of Classification Search ..... 362/294, 362/373; 381/397, 57, 165, 395, 189, 124; 361/694

See application file for complete search history.

(56) References Cited

U.S. PATENT DOCUMENTS

| | | | | |
|---|---|---|---|---|
| 7,535,341 | B2 * | 5/2009 | Haase | 340/326 |
| 2005/0237218 | A1 * | 10/2005 | Tang et al. | 340/815.45 |
| 2007/0269074 | A1 * | 11/2007 | Broadley et al. | 381/386 |
| 2010/0289998 | A1 * | 11/2010 | Pei | 349/161 |

* cited by examiner

*Primary Examiner* — Evan Dzierzynski

(74) *Attorney, Agent, or Firm* — Muncy, Geissler, Olds & Lowe, PLLC

(57) ABSTRACT

An illuminating device comprises a heat sink, at least one light emitting module and a speaker. The heat sink has a first containing space, a second containing space and a first channel being in communication with the first containing space and the second containing space. The light emitting module is arranged in the first containing space and contacted with the heat sink. The speaker comprising a thin film is arranged in the second containing space. When the speaker is in operation, the thin film vibrates so that a first airflow from the second containing space to the first containing space through the first channel is formed. In the above-mentioned illuminating device, the vibration of the thin film of the speaker causes air in the first containing space to flow, and the heat dissipation efficiency of the illuminating device is improved.

22 Claims, 3 Drawing Sheets

ILLUMINATING DEVICE HAVING A SPEAKER

BACKGROUND OF THE INVENTION (a) Field of the Invention

The invention relates to an illuminating device, particularly to an illuminating device having a speaker and a LED (light emitting diode) lighting fixture.

(b) Description of the Related Art

Light emitting diodes (LED) have various advantages like compact size, long life time, and power saving, etc. so that they have been widely applied in various fields, such as display backlight modules, lighting fixtures, traffic lights, and decoration, etc.

In order to promote the applicability of a light emitting diode to lighting fixtures, avoiding a LED from being burned out and how to dissipate heat while a LED emits light are very important in the development of a LED lighting fixture. Traditionally, the heat dissipation method for a LED lighting fixture is to transmit the heat generated from light emitting diodes while emitting light to a heat sink and then transmit to ambient air through the heat sink having a relatively large surface area. However, if the ambient air of the heat sink does not flow, the heat dissipation efficiency of the LED lighting fixture is reduced. Thus, it is still necessary to improve the conventional LED lighting fixtures. Besides, it is also a trend to incorporate other functions into a LED lighting fixture while the conventional LED lighting fixture only has the lighting function.

In conclusion, how to appropriately incorporate other functions into a LED lighting fixture and increase the heat dissipation efficiency of a LED lighting fixture is urgently required.

BRIEF SUMMARY OF THE INVENTION

In light of the above-mentioned problems, one object of the invention is to provide an illuminating device having a speaker to improve the heat dissipation efficiency of the illuminating device by causing ambient air to flow via the vibration of the speaker.

One embodiment of the invention provides an illuminating device, comprising a heat sink, at least one light emitting module, and a speaker. The heat sink has a first containing space, a second containing space and a first channel being in communication with the first containing space and the second containing space. The light emitting module is arranged in the first containing space and contacted with the heat sink. The speaker comprises a thin film and is arranged in the second containing space. The thin film vibrates while the speaker is in operation so that a first airflow from the second containing space to the first containing space through the first channel is formed.

Another embodiment of the invention provides a light emitting diode (LED) lighting fixture, comprising a heat sink, at least one light emitting diode module, and a speaker. The heat sink has a first containing space, a second containing space and a first channel being in communication with the first containing space and the second containing space. The light emitting diode module is arranged in the first containing space and contacted with the heat sink. The speaker comprises a thin film and is arranged in the second containing space.

According to the illuminating device and the LED lighting fixture of the invention, the vibration of the speaker causes the ambient air of the heat sink to flow so that the heat dissipation efficiency of the illuminating device and the LED lighting fixture is improved and the illuminating device and the LED lighting fixture have the speaker function.

Other purposes and advantages of the invention can be understood by the following disclosed technical characteristics of the invention. Accompanying with the following figures, examples and claims, the above and other objectives and advantages of the invention will be described in detail in the following.

DETAILED DESCRIPTION OF THE INVENTION

The above and other technical content, characteristics, and functions of the invention will be described in details with reference to the drawings. For clarity, the wording related to direction, such as up, down, left, right, front, back, and etc., used in examples is referred to the direction in drawings. Therefore, the wording related to direction is not used to limit the scope of the invention.

Figure 1:
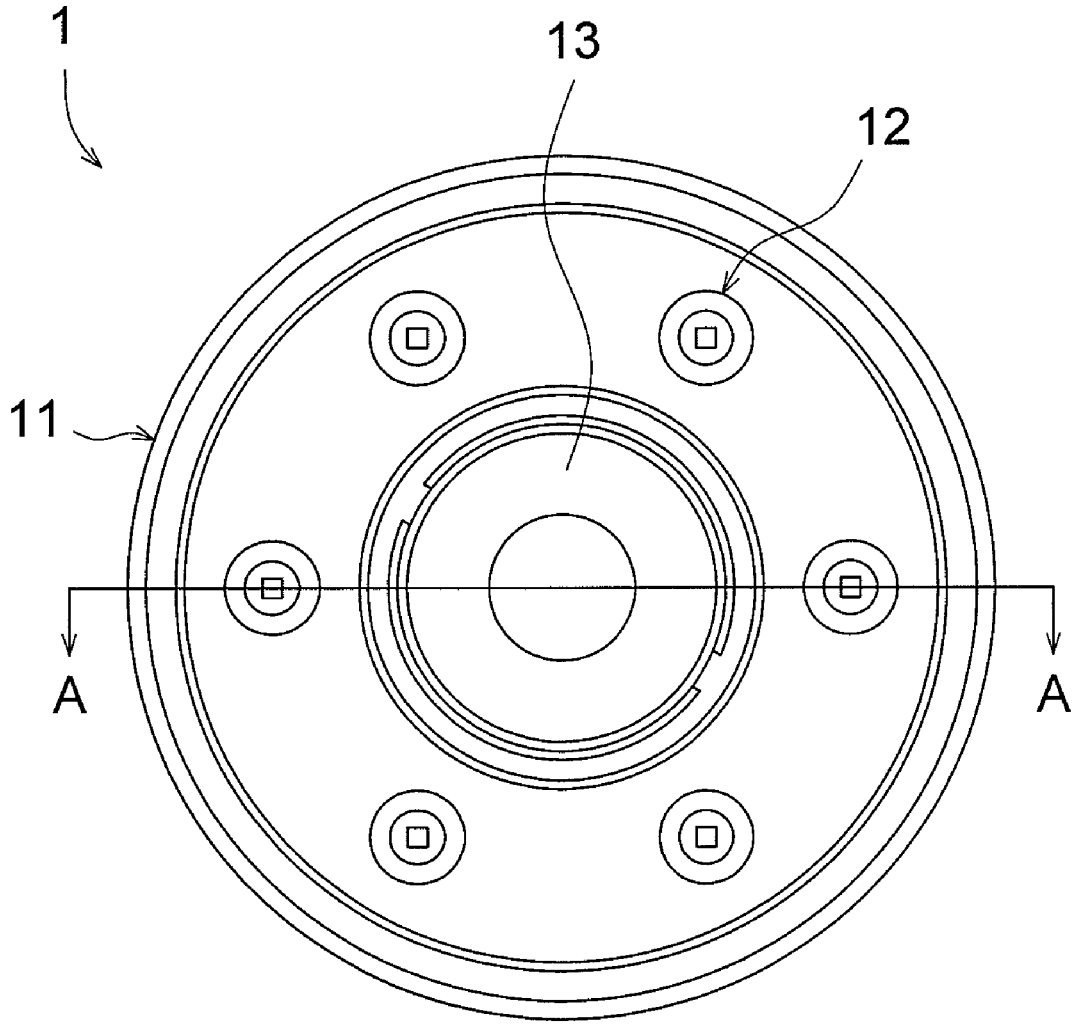
FIG. 1 is a top view showing an illuminating device according to one embodiment of the invention.
Figure 2:
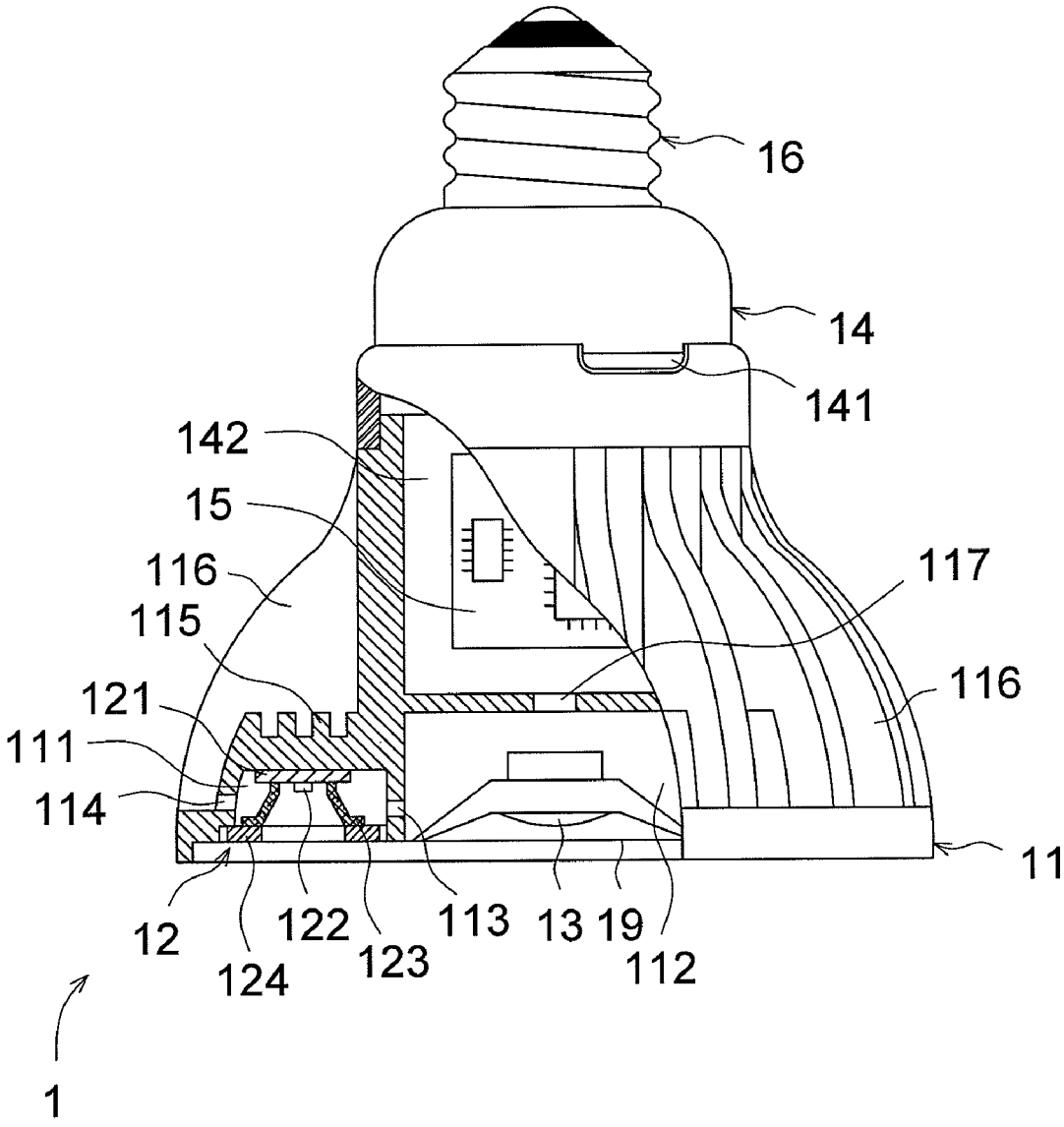
FIG. 2 is a cross-sectional side view showing the cross section of the illuminating device along the AA line shown in FIG. 1 according to one embodiment of the invention.

FIG. 1 is a top view showing an illuminating device according to one embodiment of the invention. FIG. 2 is a cross-sectional side view showing the cross section of the illuminating device along the AA line shown in FIG. 1 according to one embodiment of the invention. Referring to FIG. 1 and FIG. 2, the illuminating device 1 according one embodiment of the invention comprises a heat sink 11, at least one light emitting module, and a speaker 13. In one embodiment, the illuminating device 1 can be a light emitting diode (LED) lighting fixture while the light emitting module can be a LED module 12.

Continuing the above description, the heat sink 11 has a first containing space 111, a second containing space 112 and a first channel 113. The first channel 113 is in communication with the first containing space 111 and the second containing space 112. In one embodiment, the heat sink 11 comprises a plurality of first heat-dissipating fins 115 arranged on the opposite side of the first containing space 111. The first heat-dissipating fins 115 increase the surface area of the heat sink 11 so that the heat dissipation efficiency of the heat sink 11 is enhanced. In one embodiment, the heat sink 11 can also comprise a plurality of second heat-dissipating fins 116 arranged on the outer surface of the heat sink 11. Similarly, the second heat-dissipating fins 116 increase the surface area for dissipating the heat generated by the illuminating device 1 so that the heat dissipation efficiency of the heat sink 11 is enhanced.

Referring to FIG. 2, the LED module 12 is arranged in the first containing space 111 of the heat sink 11 and attached to the heat sink 11. Thus, the heat generated by the LED module 12 can be dissipated through the heat sink 11 to avoid damaging the LED module 12 due to overheat. For example, the LED module 12 comprises a substrate 121 and the LED chip 122 is mounted on the substrate 121 and electrically couples to the substrate 121. In one embodiment, the LED chip 122 can be a red LED, green LED, blue LED, white LED or the combination of the above. The LED module 12 can comprise a cover plate 124 for covering the opening end of the first containing space 111.

In one embodiment, the LED module 12 comprises a reflective element 123 for reflecting the light emitted from the LED chip 122 to increase the light output efficiency of the LED module 12. As shown in FIG. 2, the reflective element 123 has a cup shape and the LED chip 122 is arranged at the bottom of the cup-shaped reflective element 123. The light emitted from the LED chip 122 can be reflected by the inner wall of the reflective element 123 and then outputted.

Continuing the above description, the speaker 13 comprising a thin film 19 is arranged in the second containing space 112 of the heat sink 11. According to the above structure, the thin film 19 of the speaker 13 generates sound and produces vibration so that the illuminating device 1 according to one embodiment of the invention has the speaker function. Thus, a user can have both illumination and speaker functions to effectively utilize space. For example, in a limited exhibition space, the illuminating device 1 according to the invention is arranged to illuminate the exhibits and the speaker 13 can broadcast the explanation of the exhibits. At the same time, the vibration of the thin film of the speaker 13 causes the formation of the first airflow from the second containing space 112 to the first containing space 111 through the first channel 113. Simply speaking, the vibration of the thin film 19 of the speaker 13 causes the air in the first containing space 111 to flow so that the cooler air flows towards the first containing space 111 and thus the ambient temperature of the LED chip 122 is effectively decreased. In one embodiment, the opening of the first channel 113 on the side of the second containing space 112 and the thin film 19 of the speaker 13 are positioned at different levels so that the first airflow can smoothly pass the first channel 113.

Referring to FIG. 2, the first containing space 111 can comprise an air opening 114. In one embodiment, the first channel 113 is positioned between the air opening 114 and the thin film 19 of the speaker 13 so that the first airflow can pass through the first channel 113 and then pass through the air opening 114. Thus, the airflow from the second containing space 112 passing through the first channel 113 can flow out of the first containing space 111 from the air opening 114 after passing through the reflective element 123 of the light emitting module so that airflow in the first containing space 111 is increased and thus the heat dissipating efficiency is enhanced. Preferably, the first airflow can also pass between the first heat-dissipating fin 115 and the second heat-dissipating fin 116 so that the heat of the first heat-dissipating fin 115 can be carried away and can be transmitted to external air via the second heat-dissipating fins 116.

Referring to FIG. 2, the illuminating device 1 of the invention further comprises a base 14, a circuit board 15 and a power contact 16. One end of the base 14 is connected to the heat sink 11 so that a space 142 is defined while the other end of the base 14 is connected to the power contact 16. In one embodiment, the base 14 has an air orifice 141 while the heat sink 11 has a second channel 117 positioned between the thin film 19 of the speaker 13 and the air orifice 141 and being in communication with the space 142 and the second containing space 112. Thus, when the thin film 19 of the speaker 13 vibrates, a second airflow from the second containing space 112 to the space 142 through the second channel 117 is formed and flows out of the illuminating device 1 via the air orifice 141. The air orifice 141 is used as the inlet/outlet for external air and the audio wire of the speaker 13 can electrically couple to an external audio source through the air orifice 141. In one embodiment, the space between the second heat-dissipating fin 116 and the first heat-dissipating fin 115 can be in communication with the air orifice 141 so that the first airflow can flow to external environment through the air orifice 141.

The circuit board 15 comprises a functional circuit and is arranged in the space 142. The circuit board 15 is electrically coupled to the LED module 12 and the speaker 13 to drive and/or control the LED module 12 and the speaker 13. The power contact 16 is electrically coupled to the external lamp holder for supplying electric power to the illuminating device 1. For example, the power contact 16 shown in FIG. 2 is a screw-type joint but is not limited to this example. It can be a pin-type joint.

In order to effectively utilize the vibration of the speaker 13, the opening of the first channel 113 on the side of the second containing space 112 can be arranged at the position near the thin film of the speaker 13. As shown in FIG. 2, the opening of the first channel 113 is at the position lower than the position of the thin film 19 of the speaker 13. But, the invention is not limited to this design. The opening of the first channel 113 can be at the position higher than that of the thin film 19 of the speaker 13.

Figure 3:
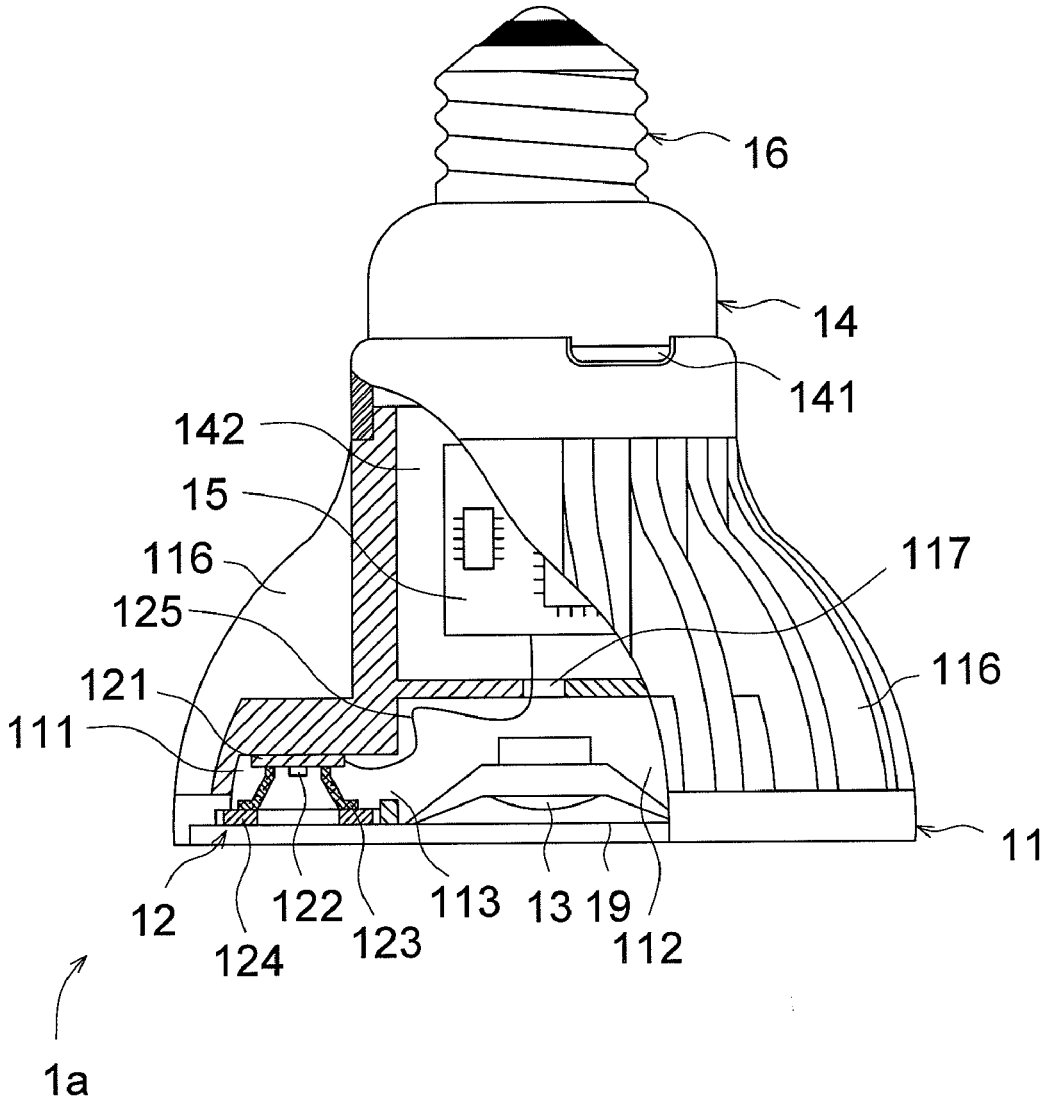
FIG. 3 is a cross-sectional side view showing the cross section of the illuminating device along the AA line shown in FIG. 1 according to another embodiment of the invention.

FIG. 3 is a cross-sectional side view showing the cross section of the illuminating device along the AA line shown in FIG. 1 according to another embodiment of the invention. The illuminating device 1*a* shown in FIG. 3 is similar to the illuminating device 1 shown in FIG. 2. Thus, the same element uses the same symbol and the related description is omitted. The following will only describe the differences. In this embodiment, the structure of the illuminating device 1*a* is simplified to have no first heat-dissipating fin 115 and no air opening 114. In this embodiment, when the thin film 19 vibrates, air is caused to flow from the air orifice 141 into the illuminating device 1*a* and cool air flows through the space 142 defined by one end of the base 14 and the heat sink 11 and then flows from the second containing space 112 to the first containing space 111. Heat exchange occurs between the cool air and the LED module 12 (particularly, the reflective element 123) to thereby generate hot air. The hot air flows from the first containing space 111 to the second containing space 112 and finally passes through the space 142 to exit via the air orifice 141. In one embodiment, the illuminating device 1*a* can be arranged on the ceiling since cool air flows downward and hot air flows upward. Thus, the hot air can easily flow from the first containing space 111 to the second containing space 112 and finally pass through the space 142 to exit via the air orifice 141. Therefore, the heat dissipation efficiency can be further enhanced.

According to the illuminating device of the invention, a speaker is incorporated into the illuminating device so that the illuminating device has the speaker function and besides the heat dissipation efficiency of the illuminating device is enhanced by the vibration of the speaker to cause the ambient air of the light emitting module to flow.

Although the present invention has been fully described by the above embodiments, the embodiments should not constitute the limitation of the scope of the invention. Various modifications or changes can be made by those who are skilled in the art without deviating from the spirit of the invention. The scope of the present invention is to be encompassed by the claims of the present invention. Any embodiment or claim of the present invention does not need to reach all the disclosed objects, advantages, and uniqueness of the invention. Besides, the abstract and the title are only used for assisting the search of the patent documentation and should not be construed as any limitation on the implementation range of the invention.

What is claimed is:

1. An illuminating device, comprising:

a heat sink, having a first containing space, a second containing space and a first channel being in communication with the first containing space and the second containing space;

at least one light emitting module, arranged in the first containing space and being in contact with the heat sink; and a speaker, comprising a thin film and being arranged in the second containing space;

wherein the thin film vibrates while the speaker is in operation so that a first airflow from the second containing space to the first containing space through the first channel is formed.

2. The device according to claim 1, wherein the first containing space comprises an air opening for the first airflow flowing out of the first containing space.

3. The device according to claim 2, wherein the first channel is arranged between the air opening and the thin film of the speaker.

4. The device according to claim 2, further comprising:

a plurality of first heat-dissipating fins arranged on the opposite side of the first containing space.

5. The device according to claim 4, further comprising:

a plurality of second heat-dissipating fins arranged on the outer surface of the heat sink so that the first airflow can flows through the first heat-dissipating fins and the second heat-dissipating fins.

6. The device according to claim 1, wherein the opening of the first channel on the side of the second containing space and the thin film of the speaker are positioned at different levels.

7. The device according to claim 1, further comprising:

a base having an air orifice and being connected to the heat sink so that a space is defined between one end of the base and the heat sink;

a circuit board, comprising a functional circuit arranged in the space wherein the circuit board is electrically coupled to the light emitting module and the speaker; and a power contact be connected to the other end of the base and is electrically coupled to the circuit board.

8. The device according to claim 7, wherein the heat sink further comprises a second channel being in communication with the space and the second containing space, and wherein while the thin film vibrates, a second airflow is formed which flows from the second containing space to the space through the second channel and flows out of the illuminating device via the air orifice.

9. The device according to claim 1, wherein the light emitting module is a light emitting diode module.

10. The device according to claim 9, wherein the light emitting diode module comprises a light emitting diode chip and a reflective element reflecting the light emitted from the light emitting diode chip and the first airflow flows through the reflective element.

11. A light emitting diode lighting fixture, comprising:

a heat sink, having a first containing space, a second containing space and a first channel being in communication with the first containing space and the second containing space;

at least one light emitting diode module, arranged in the first containing space and being in contact with the heat sink; and a speaker, comprising a thin film and being arranged in the second containing space.

12. The lighting fixture according to claim 11, wherein the first containing space comprises an air opening and the first channel is arranged between the air opening and the thin film of the speaker.

13. The lighting fixture according to claim 11, further comprising:

a plurality of first heat-dissipating fins arranged on the opposite side of the first containing space.

14. The lighting fixture according to claim 11, further comprising:

a plurality of second heat-dissipating fins arranged on the outer surface of the heat sink.

15. The lighting fixture according to claim 11, wherein the opening of the first channel on the side of the second containing space and the thin film of the speaker are positioned at different levels.

16. The lighting fixture according to claim 11, further comprising:

a base having an air orifice and being connected to the heat sink so that a space is defined between one end of the base and the heat sink;

a circuit board, comprising a functional circuit arranged in the space wherein the circuit board is electrically coupled to the light emitting diode module and the speaker; and a power contact be connected to the other end of the base and is electrically coupled to the circuit board.

17. The lighting fixture according to claim 16, wherein the heat sink further comprises a second channel being in communication with the space and the second containing space and being arranged between the thin film of the speaker and the air orifice.

18. The lighting fixture according to claim 17, wherein an audio wire of the speaker passes through the air orifice of the base to be electrically coupled to an external audio source.

19. The lighting fixture according to claim 17, wherein the light emitting diode module comprises a light emitting diode chip and a reflective element reflecting the light emitted from the light emitting diode chip and the first airflow flows through the reflective element.

20. The lighting fixture according to claim 17, wherein the light emitting diode module comprises a red, green, or blue light emitting diode or the combination of the above.

21. The lighting fixture according to claim 17, wherein the power contact is a screw-type joint.

22. The lighting fixture according to claim 17, wherein the power contact is a pin-type joint.

* * * * *